US008001706B2

(12) United States Patent
Jeffers et al.

(10) Patent No.: US 8,001,706 B2
(45) Date of Patent: Aug. 23, 2011

(54) COVER FOR EMBELLISHING FOOTWEAR

(76) Inventors: Edwina Dee Jeffers, San Pedro, CA (US); Gary S. Dunbar, Los Angeles, CA (US)

( * ) Notice: Subject to any disclaimer, the term of this patent is extended or adjusted under 35 U.S.C. 154(b) by 0 days.

(21) Appl. No.: 13/050,247

(22) Filed: Mar. 17, 2011

(65) Prior Publication Data

US 2011/0162237 A1 Jul. 7, 2011

Related U.S. Application Data

(63) Continuation-in-part of application No. 12/056,188, filed on Mar. 26, 2008.

(51) Int. Cl.
*A43B 3/16* (2006.01)
*A43B 17/00* (2006.01)

(52) U.S. Cl. ..... 36/136; 36/7.1 R; 36/72 R; 2/239; 2/245

(58) Field of Classification Search ..... 36/100, 36/136, 7.1 R, 7.2, 72 R, 55, 2 R; 2/239, 2/245

See application file for complete search history.

(56) References Cited

U.S. PATENT DOCUMENTS

| | | | | |
|---|---|---|---|---|
| 2,420,618 | A * | 5/1947 | Rabinovitz | 36/2 R |
| 2,904,980 | A * | 9/1959 | Stinson | 66/171 |
| 3,087,260 | A * | 4/1963 | Hudon | 36/7.2 |
| 3,250,025 | A * | 5/1966 | Crescent | 36/72 R |
| 4,538,368 | A * | 9/1985 | Mugford | 36/112 |
| 4,748,749 | A * | 6/1988 | Colvard | 36/2 R |
| 4,850,122 | A * | 7/1989 | Schwab, Jr. | 36/72 R |
| 5,165,182 | A * | 11/1992 | Michael | 36/1.5 |
| 5,325,542 | A * | 7/1994 | Lenerville | 2/244 |
| 5,501,022 | A * | 3/1996 | Cohn | 36/2 R |
| 5,544,430 | A * | 8/1996 | Jacko | 36/7.1 R |
| 5,950,333 | A * | 9/1999 | Tsen | 36/7.1 R |
| 5,987,778 | A * | 11/1999 | Stoner | 36/1.5 |
| 6,038,792 | A * | 3/2000 | Hauter | 36/133 |
| 6,651,257 | B2 * | 11/2003 | Smith | 2/239 |
| 2002/0029405 | A1 * | 3/2002 | Outwater | 2/239 |
| 2002/0088254 | A1 * | 7/2002 | Singleton | 66/177 |
| 2007/0084080 | A1 * | 4/2007 | Heiderer et al. | 36/2 R |
| 2009/0188020 | A1 * | 7/2009 | Beaumont | 2/239 |
| 2009/0241380 | A1 * | 10/2009 | Jeffers et al. | 36/136 |

* cited by examiner

*Primary Examiner* — Marie Patterson
(74) *Attorney, Agent, or Firm* — Robert J. Lauson; Lauson & Tarver LLP

(57) ABSTRACT

A decorative cover for embellishing footwear is disclosed, having a cover incorporated with a sock. The cover is worn over the footwear for covering and enhancing it with at least one embellishment. The sock encloses a user's foot and is incorporated with the cover at the top of the sock to prevent the cover slipping down. To hold the cover down over the footwear, a disconnecting strap extends under the arch of the footwear. To hold the cover securely against the footwear, a zippered seam runs along the rear of the cover parallel to a user's leg.

15 Claims, 12 Drawing Sheets

COVER FOR EMBELLISHING FOOTWEAR

CROSS-REFERENCE TO RELATED APPLICATIONS

This is a continuation-in-part of application Ser. No. 12/056,188, filed Mar. 26, 2008.

FIELD OF THE INVENTION

This invention relates to footwear accessories, and more particularly to a boot glove incorporated with a sock and embellishments for covering the footwear safely and healthy.

BACKGROUND

A boot is a type of shoe that covers at least the foot and the ankle and sometimes extends up to the knee or even the hip. Most of the boots has a heel that is clearly distinguishable from the rest of the sole, even if the two are made of one piece. Traditional boots are made of leather or rubber and modern boots are made from a variety of materials.

Some boots are made of a single closely-stitched design using leather, rubber, canvas, or similar material to prevent the entry of water, snow, mud or dirt through the gaps left between the laces and the tongue as in regular types of shoes. Simple waterproof gumboots are made in different lengths of uppers, and, in extreme cases, thigh-boots called waders, worn by anglers, extends up to the hip level of the wearer. Such boots may also be insulated for warmth.

In one prior art, a plastic sock that is adapted for use in combination with a boot or galosh for facilitating insertion of the foot is disclosed. The sock keeps the feet dry while the over boot is worn. The provision of an adjustable tubular sock for use in combination with a boot comprising a liquid impermeable single sheet having a tubular configuration and one open end, the open end having a rim portion, the rim portion including means for receiving the sheet about the leg, the sheet being in contact with the inside surface of an outer boot.

A sock that is particularly adapted for use with western type boots in which the heel portion is enlarged to a greater extent than the heels of regular boots and shoes is disclosed in another prior art. The entire length of the leg, foot and heel portions of this sock are knit of one or more body yarns and a main terry yarn forms terry loops throughout either the entire inner surface of the sock or at least in the heel. An auxiliary terry yarn is knit in plated relationship with the main terry yarn in at least the heel portion and may be knit in the adjacent areas above and below the heel portion and forms additional terry loops to provide additional fabric thickness in the heel and adjacent areas so that the heel portion of the sock fills in the enlarged heel of the western boot. The yarns forming the terry loops are hydrophobic to wick any moisture from the inside of the sock and away from the foot of the wearer.

In addition, another prior art discloses a woman's modular utility shoe. A convertible base mule-style shoe may be made of an insole, an outsole, a sash, a vamp or upper, and a heel attached to the outsole or to a heel mount. Various attachment mounts fastened to the base mule may allow structural embellishments to be attached to the base mule.

These prior arts allow the user to use the footwear without using the socks and may build up of bacteria, causing irritation and itching to the feet. Also the embellishments attached outside the footwear are specific to the footwear and can easily slip down causing accidents. The accidents such as tripping over the embellishments, causes sprains and broken feet or ankles. Further, the embellishments are specific to the footwear and footwear style.

Therefore, there is a need for a device that allows the user to safely and healthily use the boot by using a boot glove incorporated with boot glove sock. There is also a need for an antibacterial boot glove sock that absorbs perspiration and bacteria caused by perspiration. Additionally, as the embellishments are done on the boot glove and not on the boot, the boot glove can be used with all types of footwear and footwear style. The present invention accomplishes these objectives.

SUMMARY

The present invention is a boot glove that can be used for embellishing all the footwear healthy and safely. The boot glove comprises of a boot glove body and a boot glove sock. The boot glove body worn over the boot covers and enhances the boot with at least one embellishment. The boot glove sock encloses the human foot and is incorporated with the boot glove body in order to avoid slipping down of boot glove in the event of malfunction.

In one embodiment of the invention, the embellishments are a plurality of lacing bands extending about the front of the boot glove body and a plurality of laces extending around the top of the boot glove body.

The boot glove body functions only with the boot glove sock in order to safely, healthily and economically embellish the boot. The boot glove body is kept in place with the boot glove sock which is worn on the foot. A cuff can be attached with the sock wherein said cuff when folded over the top of the boot, provides additional comfort and grip while on a walk. The boot glove application accommodates all footwear regardless of footwear style.

To accommodate all types and styles of footwear, the boot glove body, alternatively referred to as a "cover" has an upper opening and a lower opening. A disconnecting strap with fasteners spans the lower opening of the cover. The cover also has a seam and zipper running vertically upward from the heel area of the footwear, which anchors the apparatus to the footwear.

Other features and advantages of the present invention will become apparent from the following more detailed description, taken in conjunction with the accompanying drawings, which illustrate, by way of example, the principles of the invention.

DESCRIPTION

Figure 1:
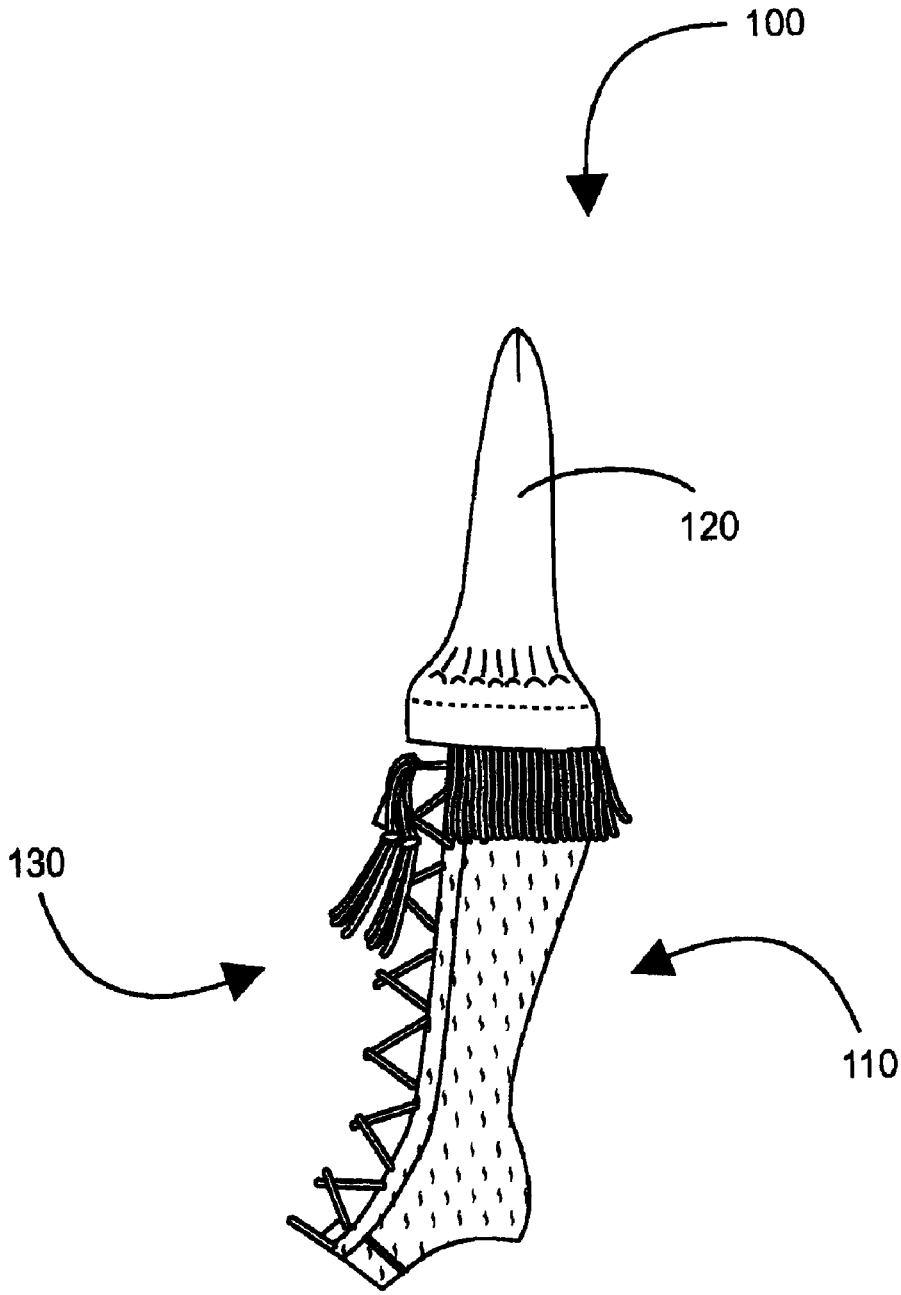
FIG. 1 is a perspective view of an embodiment of the invention, illustrating a boot glove comprising a boot glove body and a boot glove sock.

Referring to FIG. 1 is a perspective view of an embodiment of a boot glove 100 for embellishing all footwear healthy and safely. A boot glove 100 comprises of a boot glove body 110 worn over the boot (not shown) for covering and enhancing the boot (not shown) with at least one embellishment 130 and a boot glove sock 120 for enclosing the human foot. The boot glove sock 120 is incorporated with the boot glove body 130 in order to avoid slipping down of boot glove 100 in the event of malfunction.

The boot glove sock 120 is attached with the boot glove body 110 in order to firmly hold the boot glove body 110 in upright position rather than falling down in the event of malfunction. The sock 120 is made from a material that absorbs perspiration and prevents bad odor building up. The sock 120 is a fabric that is treated with an antibacterial agent in order to avoid irritation and itching caused by bacteria.

Figure 2:
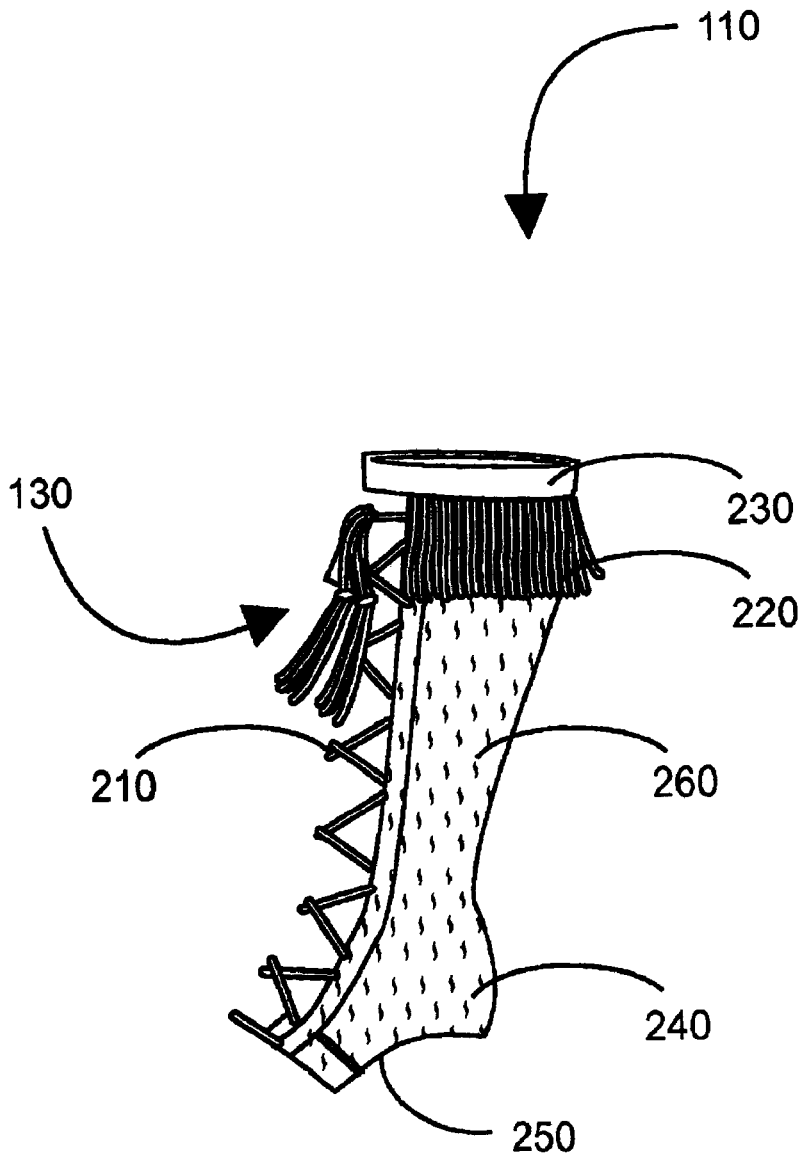
FIG. 2 is a perspective view of an embodiment of the invention, illustrating the boot glove body showing various embellishments.
Figure 3:
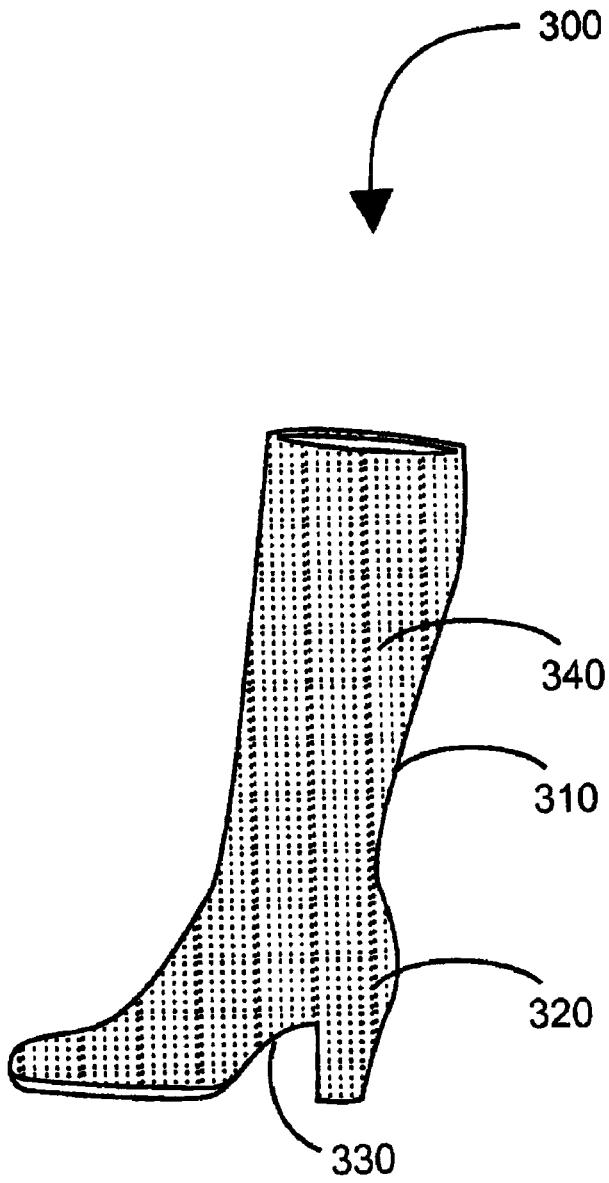
FIG. 3 is a perspective view of the boot.
Figure 4:
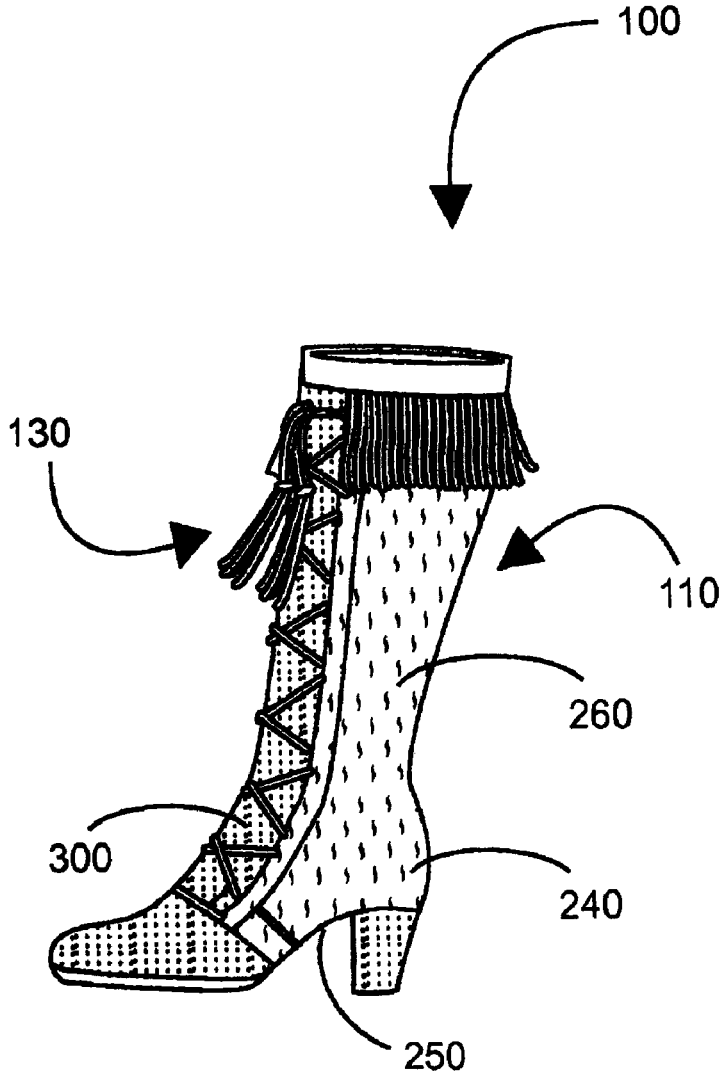
FIG. 4 is a perspective view of an embodiment of the invention, illustrating the boot glove worn over the boot.

Referring to FIG. 2 is a perspective view of the boot glove body 110 comprising of a heel section 240, arch section 250 and leg section 260 for covering the boot (not shown). FIG. 3 is the perspective view of the boot 300, showing the back 310 of the boot 300, the upper heel section 320 of the boot 300, the boot arch 330 and boot sides 340 (one side shown). The heel section 240 covers the upper heel portion 320 of the boot 300. An arch section 330 forward of the heel section 320 covers the boot arch 330 and a leg section 260 covers the back 310 and sides 340 of the boot 300.

In one embodiment of the invention, the embellishments 130 are a plurality of lacing bands 210 extending about the front of the boot glove body 110 and a plurality of laces 220 extending around the top 230 of the leg section 260 of the boot glove body 110.

The embellishments 130 may also include a sling strap, a heel strap, an ankle strap, ankle lace-up straps, a T-strap, a heel cup, a demi heel cup, or a booting. The embellishments 130 may be attached to the boot glove body 110 through many combinations of fastenings such as but not limited to a hook and eye, a double hook and eye, a clasp, a buckle, a stud, a loop a decorative snap, or like system.

The boot glove body 110 functions only with the boot glove sock 120 in order to safely, healthily and economically embellish the boot 300. The boot glove body 110 is kept in place with the boot glove sock 120 which is worn on the human foot. The boot glove 110 application accommodate all footwear regardless of footwear style.

Figure 5:
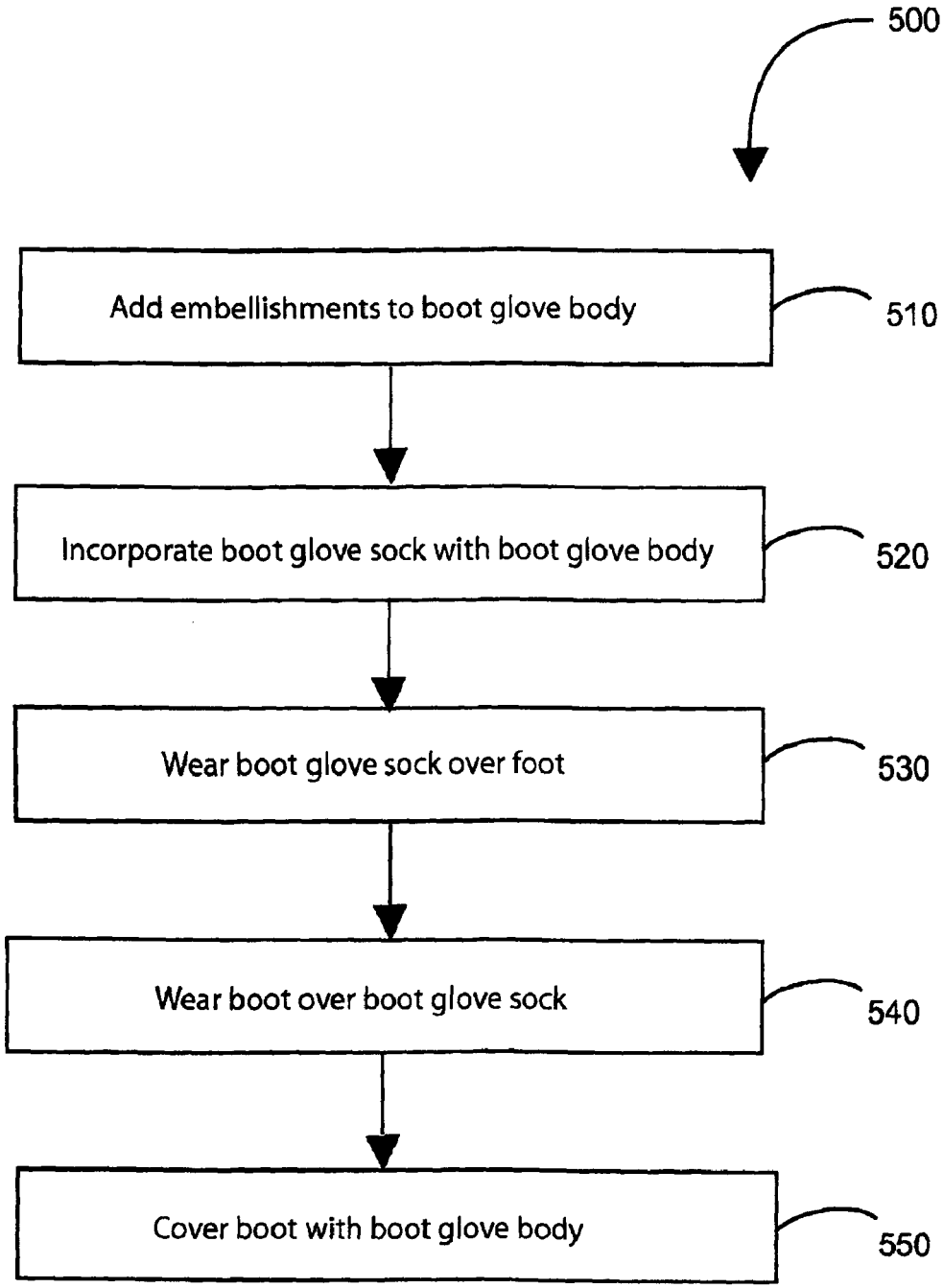
FIG. 5 is a high level flow diagram, illustrating a method for embellishing the boot healthily and safely.

Referring to FIG. 5 is a high level flow diagram illustrating a method 500 for embellishing the boot healthily and safely. As indicated by block 510, at least one embellishment is added to the boot glove body. Next, as described at block 520, the boot glove body is incorporated with the boot glove sock. The boot glove sock helps to absorb the perspiration and prevents bad order building up. The boot glove user is allowed to wear the boot glove sock first and then the boot as indicated at block 530 and 540 respectively. Finally, as described at block 550, the boot is worn over the boot glove sock such that the boot glove body covers the boot. The boot glove body covers the arch, sides, back portion and the heel potion of the boot.

Figure 6:
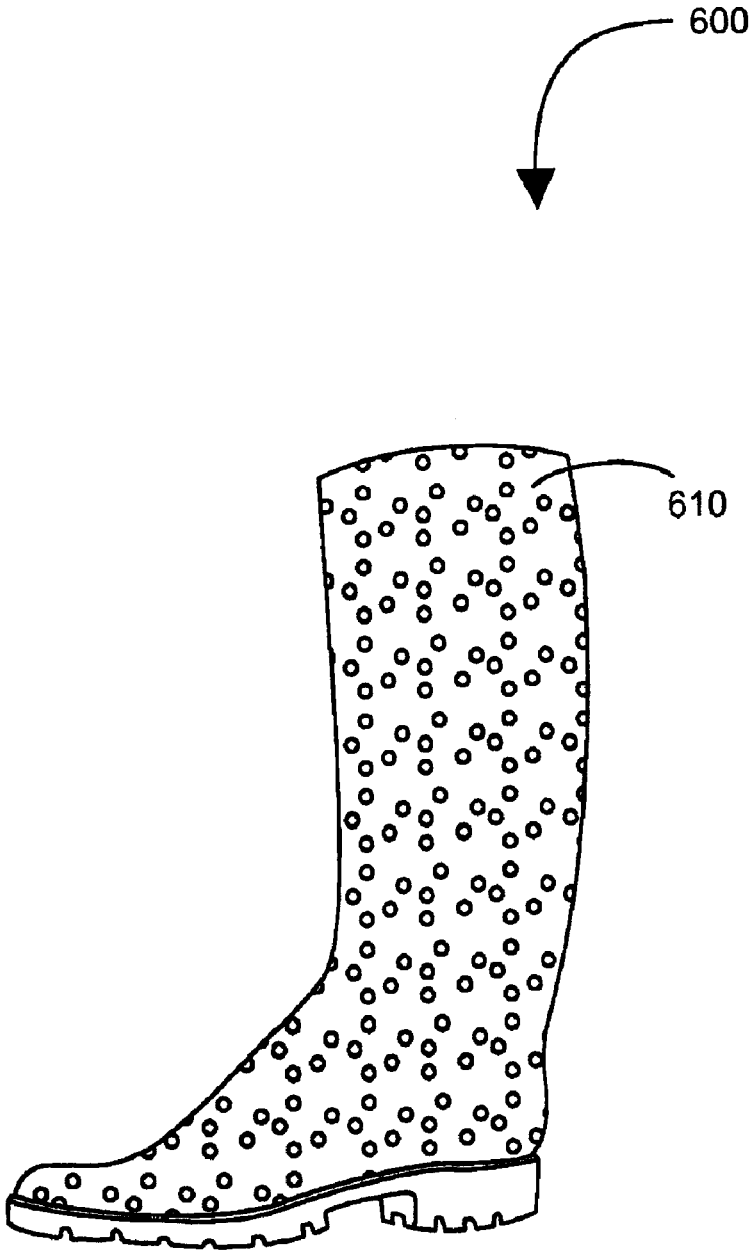
FIG. 6 is a perspective view of the boot.
Figure 7:
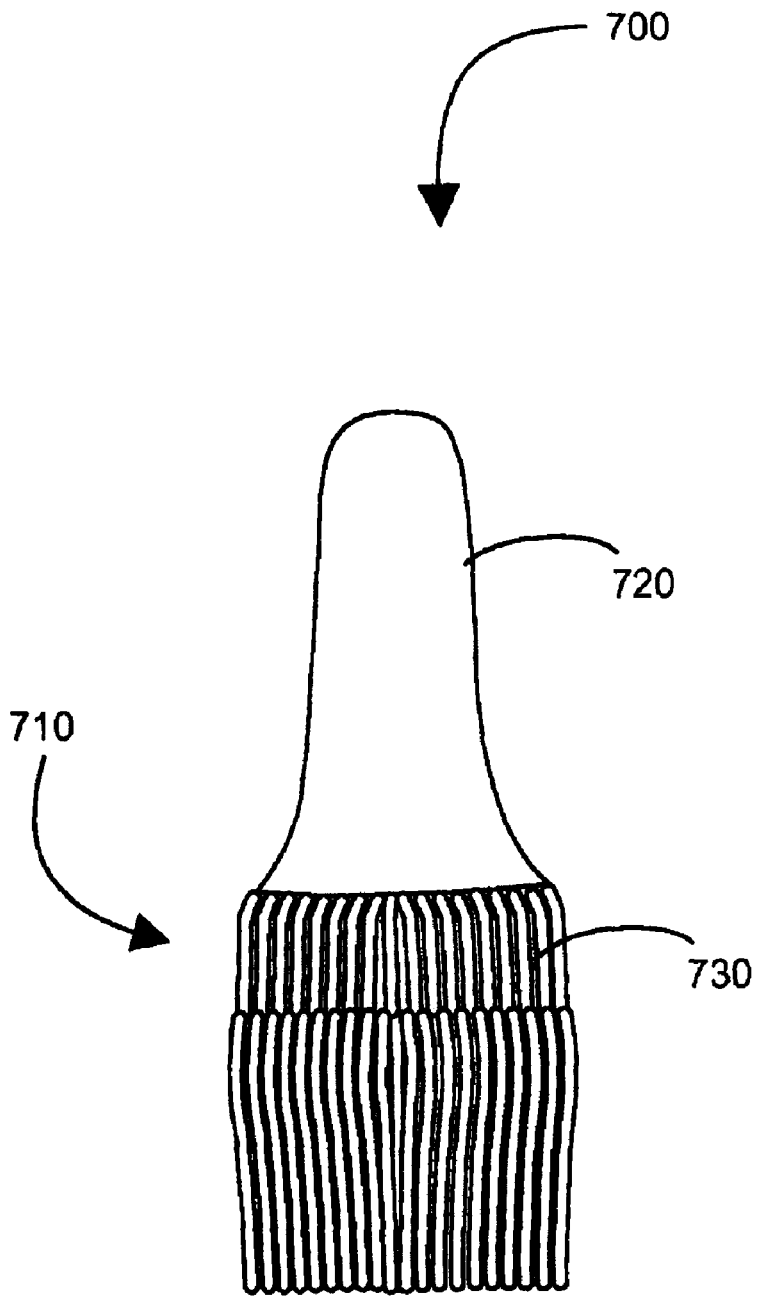
FIG. 7 is a perspective view of an alternate embodiment of the invention, illustrating a cuff with a sock.
Figure 8:
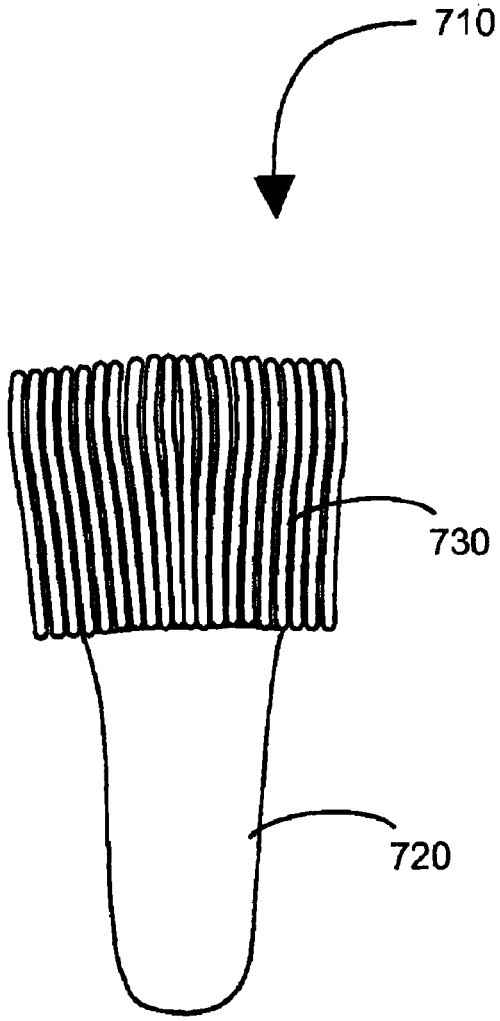
FIG. 8 is a perspective view of an alternate embodiment of the invention, illustrating the cuff folded over the sock.
Figure 9:
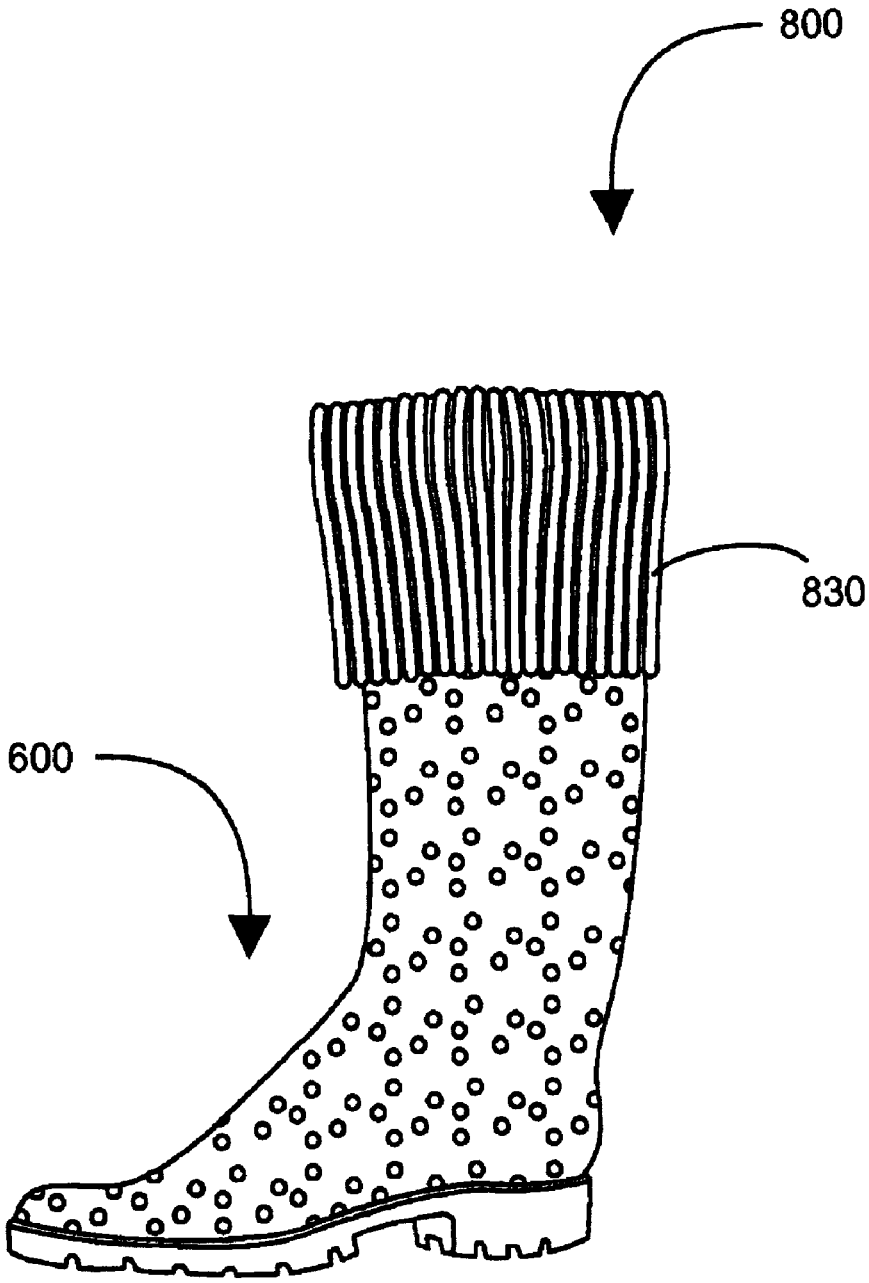
FIG. 9 is a perspective view of an alternate embodiment of the invention, illustrating the cuff folded over the top of the boot.

Referring to FIG. 6 is a perspective view of a boot 600 showing a top section 610. FIG. 7 is a perspective view of an alternate embodiment of the invention 700 illustrating a cuff 730 attached to the sock 720. FIG. 8 is the inverted view of the embodiment shown in FIG. 7 with the cuff 730 folded over the sock 720. FIG. 9 is the perspective view of an alternate embodiment of the invention 700 with the cuff 730 folded over the top section 610 of the boot. The sock 720 that is inserted into the boot 600 provides additional comfort and grip while on a walk.

Figure 10:
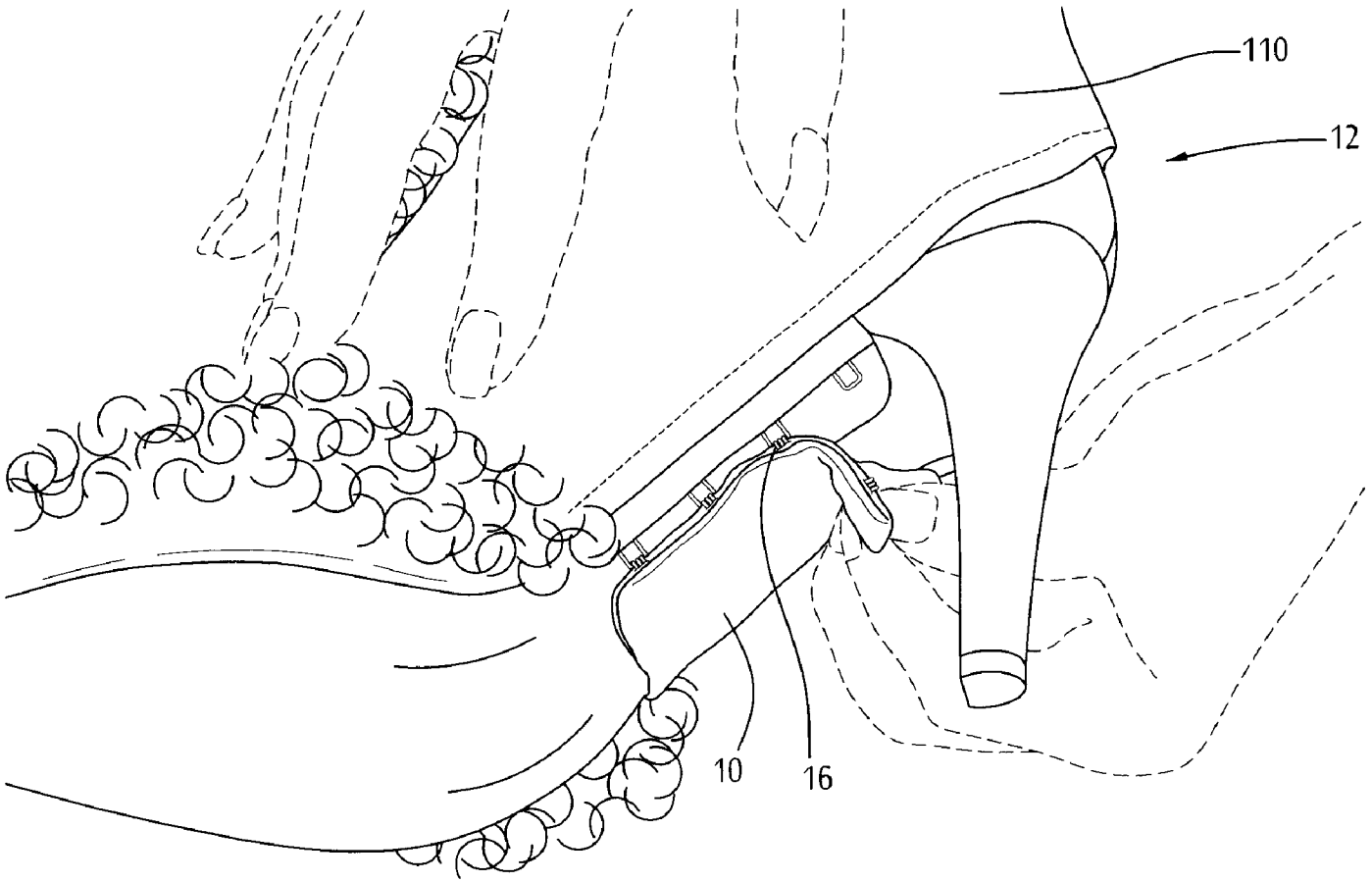
FIG. 10 is a close-up view of the strap extending under an arch of an article of footwear.

As is shown in FIG. 2, the cover 110 has an upper opening 115 and a lower opening 140. Referring now to FIG. 10, a close-up view of a releasable strap 10 is shown. In this embodiment, the strap 10 spans the lower opening 12 of the cover 110. The strap 10 is adapted to disconnect using a fastening means. In the illustrated embodiment, the fastening means comprises a series of hook and loop fasteners 16. In one embodiment, the strap is substantially inelastic.

Figure 11:
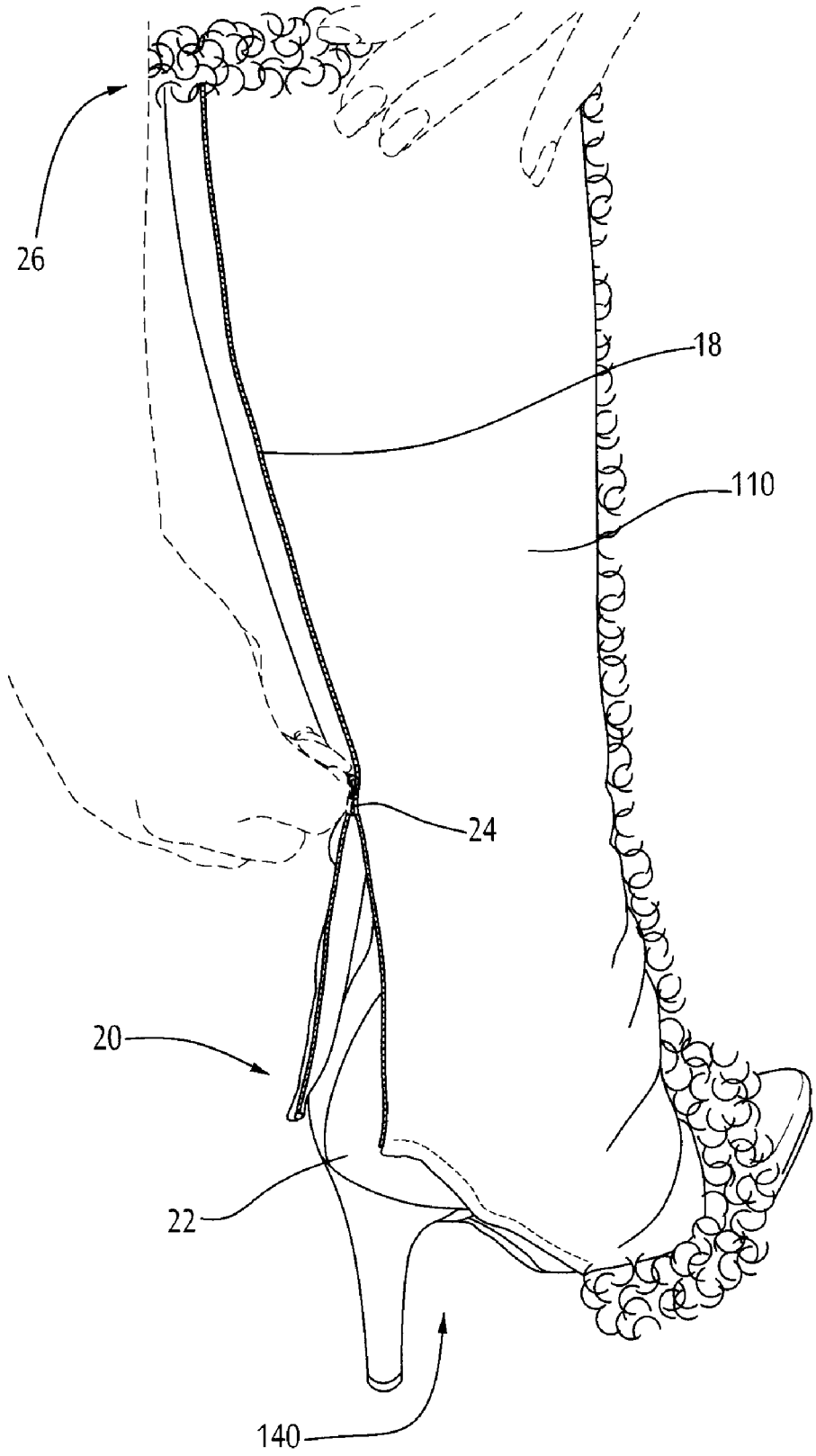
FIG. 11 is a perspective view of the rear of the cover for embellishing an article of footwear.

Referring to FIG. 11, the cover 110 has a closable seam 18 running along its length from the lower opening 140 near the heel area 20 of the shoe 22, preferably, but not necessarily covering at least the quarter and vamp of the shoe 22. The seam 18 comprises a zipper 24 or similar fastener, enabling the user to close the seam 18, and hold the cover 110 adjacent the shoe 22. Although a zipper 24 spanning the length of the cover 110 from the heel area 20 to the top 26 of the cover 110 is shown in the illustrated embodiment, anticipated alternative embodiments may have a zipper 24 extending only partially upward from the heel area 20.

Figure 12:
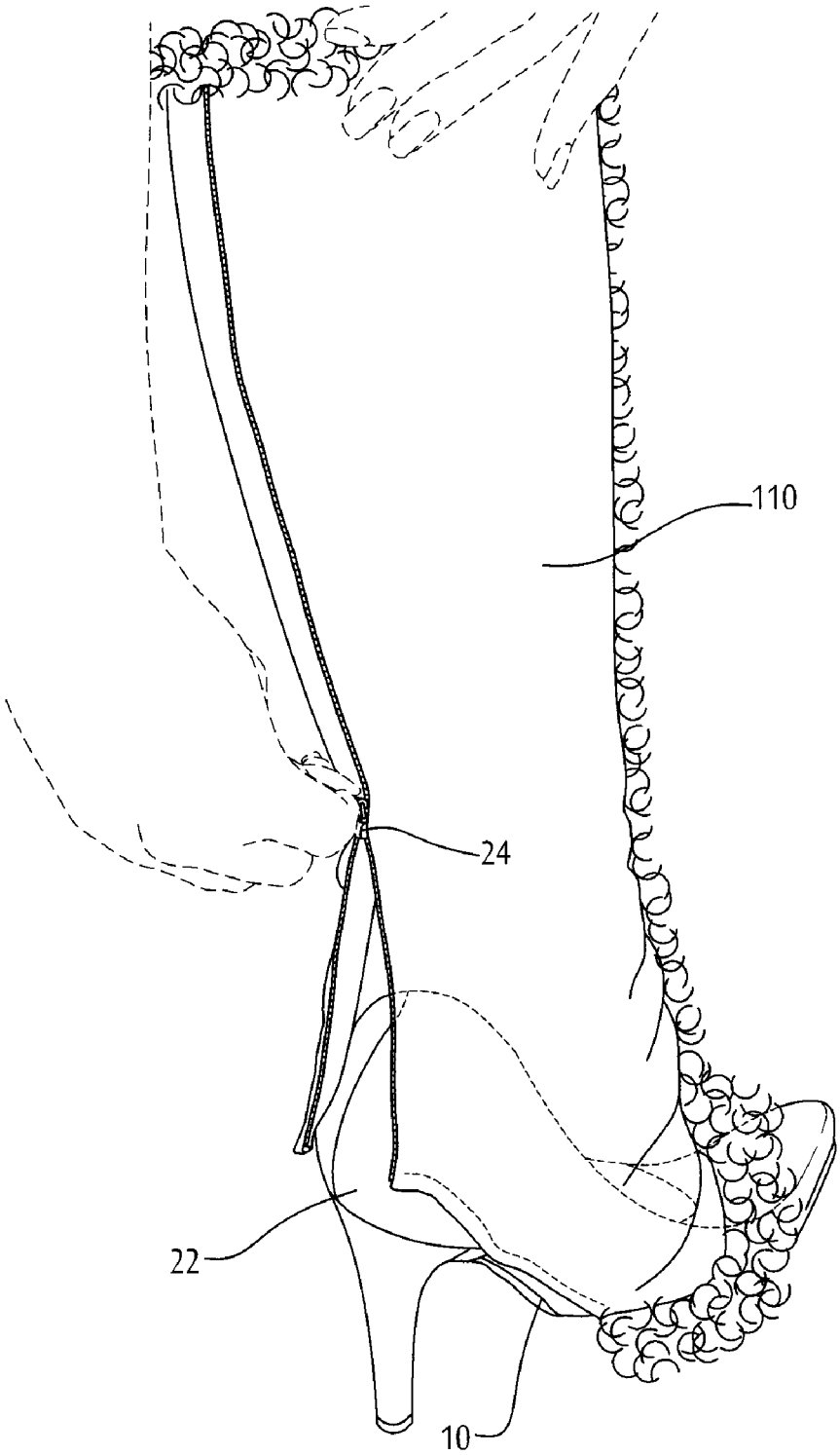
FIG. 12 is a side perspective view of the cover installed over a heeled shoe creating the illusion of a boot.

Referring to FIG. 12, it is anticipated that the cover 110 is able to impart a boot-like appearance to a variety of non-boot footwear. In the illustrated example, the cover is worn in a manner covering a heeled shoe 22. By pulling the sock 120 up and enclosing the user's leg in the cover 110 along with the shoe 22, once the strap 10 and zipper 24 are in their affixed position, the apparatus remains disposed on the user's leg above the shoe 22, giving the appearance that the shoe 22 is actually a boot.

The structure of the apparatus having been shown and described, its method of operation will now be discussed.

In order to embellish an article of foot wear, a user places the sock incorporated with the cover over a foot. At this stage, the cover hangs loosely from its connection with the sock. The user then inserts the sock and foot into an article of footwear, and brings the cover down over the exterior of the footwear. In certain cases, the sock may extend far above the footwear along a user's leg, as in the case of a court shoe or pump. In other cases, the sock may extend only to the top of the footwear, as in the case of a boot.

With the sock in place, a user brings the cover down over the outer surface of the footwear and attaches the strap under the arch of the footwear. In this manner, tension between the top of the cover held in place by the sock, and strap under the arch holds the cover over the footwear. A user then closes the zipper incorporated into a seam. In one embodiment, the seam spans the cover from bottom to top at the rear of and parallel to a user's leg with the zipper adapted to close the seam along its entire length. The cover is adapted to cover the zipper so that while the seam may remain visible, the zipper mechanism is obscured. With the strap and zipper in position, the cover is securely anchored to the article of footwear, providing a decorative appearance.

Typical applications of the present invention contemplate but are not limited to product manufacturing, installation, and maintenance. The foregoing enumeration of embodiments has been for illustrative purposes only. Other embodiments, combinations of embodiments and combinations of features are also within the scope and spirit of the teachings described herein, as will be apparent to persons skilled in the art of these teachings.

While a particular form of the invention has been illustrated and described, it will be apparent that various modifications can be made without departing from the spirit and scope of the invention. For example, structure, materials, procedure and the like that will fall within the scope of the invention. In any event, it is understood that other platform designs are also possible. Accordingly, it is not intended that the invention be limited, except as by the appended claims.

What is claimed is:

1. Apparatus for embellishing a boot upper comprising:

a cover having an upper opening, an opposing lower opening, and being adapted to substantially cover the boot upper;

at least one releasable strap member spanning the lower opening; and a sock incorporated with the cover proximate the upper opening.

2. The apparatus of claim 1 further comprising a closable seam extending substantially upward from the lower opening.

3. The apparatus of claim 2 wherein the closable seam spans the cover from the lower opening to the upper opening.

4. The apparatus of claim 2 wherein the closable seam comprises a zipper.

5. The apparatus of claim 2 wherein the cover is adapted to obscure a connector incorporated with the closable seam.

6. The apparatus of claim 1 wherein the strap is substantially inelastic.

7. The apparatus of claim 1 wherein the strap comprises at least one hook and loop fastener.

8. The apparatus of claim 1 wherein the cover is adapted to substantially cover the quarter and vamp of a boot.

9. The apparatus of claim 1, wherein the sock comprises an absorbent antiperspirant material.

10. The apparatus of claim 1, wherein the sock comprises anti-bacterial properties.

11. The apparatus of claim 1, wherein the cover is shaped to accommodate multiple footwear styles.

12. The apparatus of claim 1, further comprising a cuff at a junction of the sock and cover.

13. A method for embellishing a user's footwear comprising the steps of:

providing a decorative cover having an upper opening, an opposing lower opening, and a strap spanning the lower opening, said cover adapted to substantially cover the footwear;

incorporating the cover with a sock proximate the upper opening;

wearing the sock over the user's foot;

wearing the footwear;

pulling the cover over the footwear; and fastening the strap under the footwear;

wherein the strap holds the cover in position on the footwear in cooperation with the sock.

14. An apparatus for embellishing a shoe upper and a user's lower leg, the apparatus comprising:

a cover having an upper opening, an opposing lower opening, and being adapted to substantially cover the shoe upper;

at least one releasable strap member spanning the lower opening;

the cover being further adapted to substantially cover an area above the shoe upper; and a sock incorporated with the cover proximate the upper opening;

whereby an illusion is created that a user wearing non-boot-like shoes appears to be wearing boots.

15. The method of claim 14 further comprising the steps of:

providing a closable seam on the cover; and closing the closable seam to secure the cover adjacent the footwear.

* * * * *